US007331324B2

(12) United States Patent
James

(10) Patent No.: US 7,331,324 B2
(45) Date of Patent: Feb. 19, 2008

(54) CRANKSHAFT ROTARY VALVE

(75) Inventor: Jerome Matthew James, 3870 Cloud Dr., Colorado Springs, CO (US) 80920

(73) Assignee: Jerome Matthew James, Orlando, FL (US)

( * ) Notice: Subject to any disclaimer, the term of this patent is extended or adjusted under 35 U.S.C. 154(b) by 0 days.

(21) Appl. No.: 11/414,876

(22) Filed: May 1, 2006

(65) Prior Publication Data

US 2006/0260570 A1 Nov. 23, 2006

Related U.S. Application Data

(60) Provisional application No. 60/682,024, filed on May 17, 2005.

(51) Int. Cl.
*F02B 75/32* (2006.01)
*F02B 25/00* (2006.01)

(52) U.S. Cl. ..... 123/197.1; 123/65 R; 123/197.4

(58) Field of Classification Search ..... 123/197.4, 123/197.1, 65 R, 65 V, 73 V
See application file for complete search history.

(56) References Cited

U.S. PATENT DOCUMENTS 4,491,097 A * 1/1985 Hamann ..... 123/55.2
4,776,310 A * 10/1988 Gray ..... 123/197.4
5,950,579 A * 9/1999 Ott ..... 123/54.4
6,209,495 B1 * 4/2001 Warren ..... 123/55.2
7,093,570 B2 * 8/2006 Mavinahally et al. .... 123/73 PP
7,178,501 B2 * 2/2007 Schmidt et al. ..... 123/197.1
2002/0073954 A1 * 6/2002 Han ..... 123/197.4
2004/0040522 A1 * 3/2004 Mavinahally et al. ..... 123/73 V
2004/0255879 A1 * 12/2004 Zaytsev ..... 123/55.2
2005/0016491 A1 * 1/2005 Leiber et al. ..... 123/197.4
2005/0205025 A1 * 9/2005 Beshore ..... 123/65 R
2005/0205043 A1 * 9/2005 Schmidt et al. ..... 123/197.1
2005/0235946 A1 * 10/2005 Doers et al. ..... 123/197.4
2005/0279318 A1 * 12/2005 Nagel et al. ..... 123/196 R
2006/0048729 A1 * 3/2006 Beshore ..... 123/65 R

* cited by examiner

*Primary Examiner*—Noah P. Kamen

(57) ABSTRACT

A crankshaft rotary valve that controls fluid flow between a port located circumferentially on the crankshaft and a crankcase chamber formed by a piston, cylinder, crankcase and crankshaft. As the crankshaft rotates, a channel in the crankshaft communicates with the port and allows fluid flow to pass through the channel into a passageway that communicates between the channel and the crankcase chamber. The diameter of the crankshaft bearing surface is at least the stroke distance to greatly simplify manufacturing and assembly.

2 Claims, 2 Drawing Sheets

CRANKSHAFT ROTARY VALVE

CROSS-REFERENCE TO RELATED APPLICATIONS

This application claims an invention which was disclosed in Provisional Application No. 60/682024, filed May 17, 2005, entitled "2-Cycle Engine". The benefit under 35 USC §119(e) of the United States provisional application is hereby claimed, and the aforementioned application is hereby incorporated herein by reference.

BACKGROUND OF THE INVENTION

1. Field of the Invention

The present invention generally relates to engines and pumps and, more particularly, to an engine or pump where flow can be controlled between a port and a crankcase chamber by means of a crankshaft rotary valve.

2. Description of Related Art

Crankshaft rotary valves are very common in most single cylinder 2-cycle engines. A rotary valve operates by communicating with an intake port and a crankcase chamber. As the piston moves up, air and fuel are drawn into the crankcase chamber through a passageway in the crankshaft and intake port. The crankshaft rotary valve then closes as the crankshaft rotates and the air-fuel mixture is then compressed by the downward movement of the piston. The intake timing is set by the channel in the crankshaft rotary valve.

The difficulty in building multi-cylinder 2-cycle engines using the current crankshaft rotary valve is that the crankshaft and crankcase are difficult to manufacture and assemble due to the crankshaft offsets and bearing surfaces between the crankcase and crankshaft. This requires that the crankcase vary in size to accommodate the bearing surfaces and crankshaft offsets that the piston connecting rods are connected to. By enlarging the diameter of the bearing surface of the crankshaft to a minimum of the stroke distance, the diameter of the crankcase can be one diameter throughout the engine to greatly simplify manufacturing and assembly.

BRIEF SUMMARY OF THE INVENTION

Figure 1:
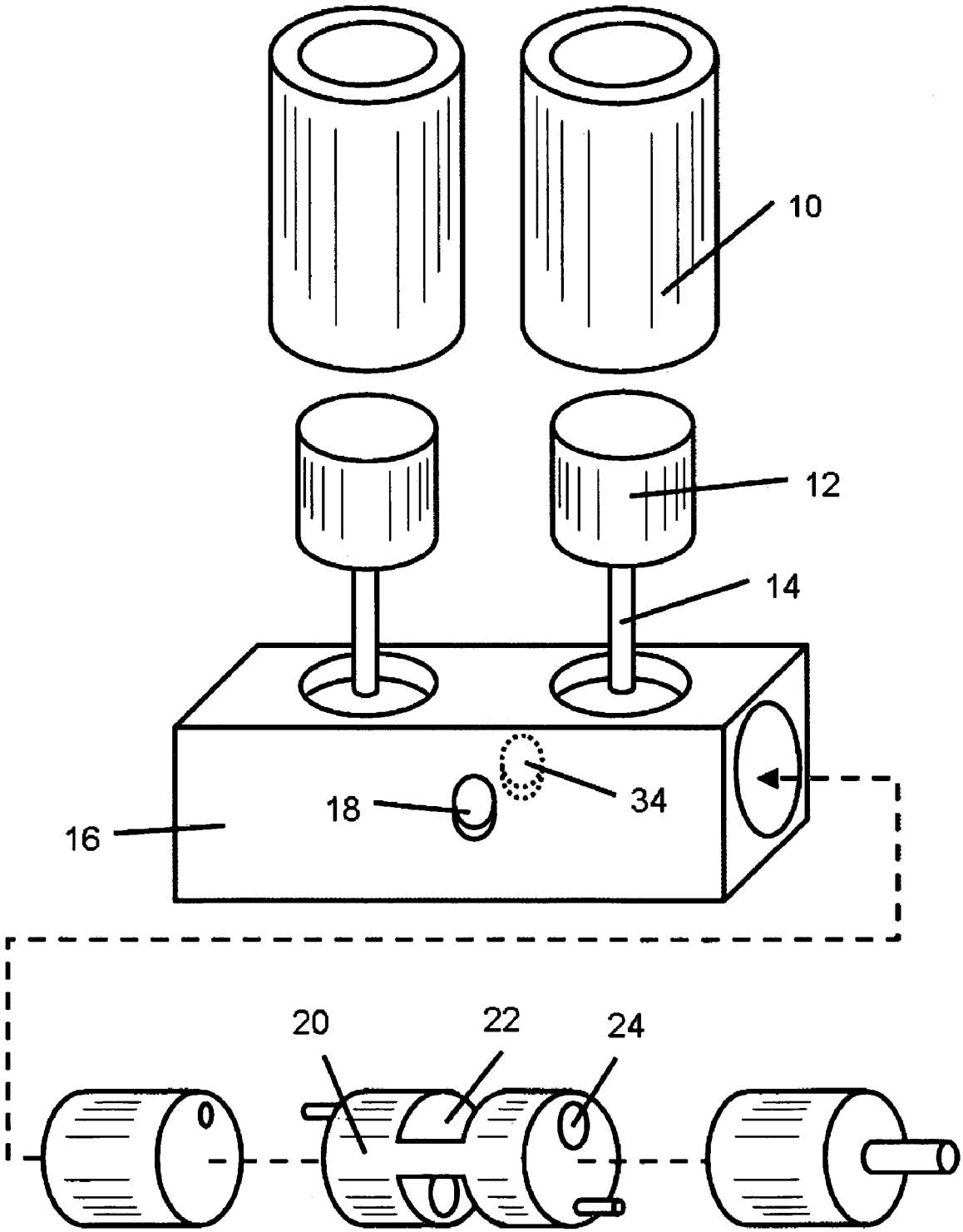
FIG. 1 shows an exploded view of the crankshaft rotary valve as used in a pressurized air engine.

| Drawings-Reference Numerals: | |
|---|---|
| 10 | Cylinder |
| 12 | Piston |
| 14 | Connecting rod |
| 16 | Crankcase |
| 18 | Intake Port |
| 20 | Crankshaft Rotary Valve-Crankshaft |
| 22 | Channel |
| 24 | Passageway |
| 26 | Exhaust Port-2-cycle Engine |
| 28 | Transfer Port |
| 30 | Cylinder Head |

-continued

| Drawings-Reference Numerals: | |
|---|---|
| 32 | Ignition Source |
| 34 | Exhaust Port-Air Pressure Engine |

DETAILED DESCRIPTION OF THE INVENTION

FIG. 1 shows the crankshaft rotary valve (20) in the most basic configuration, a steam engine or pressurized air engine. This configuration can also be used as a pump by providing rotation to the crankshaft from an external power source. By adding a 2-cycle exhaust port (26), cylinder heads (30), ignition source (32), and transfer port (28), the basic configuration can be made into a 2-cycle engine as seen in FIG. 2.

The steam engine configuration consists of a piston (12) that reciprocates within a cylinder (10). The piston (12) is attached to a crankshaft (20) via a connecting rod (14). The crankshaft (20) rotates in a crankcase (16) and converts the reciprocal motion of the piston (12) into rotary motion. The stroke distance of the engine is the distance between the piston (12) at the highest top position and the lowest bottom position in the cylinder (10). The crankshaft (20) diameter is a minimum of the stroke distance. The crankshaft (20) contains a channel (22) that is located circumferentially on the crankshaft (20) that communicates with an intake port (18). The crankshaft (20) also contains a passageway (24) that connects the channel (22) to the face of the crankshaft (20). A crankcase chamber is formed by the cylinder (10), crankcase (16), piston (12) and crankshaft (20).

The cycle begins with the channel (22) aligned to the intake port (18). Pressurized air passes through the intake port (18), into the channel (22) then through the passageway (24) to the underside of the piston (12). The pressurized air forces the piston (12) upward and rotates the crankshaft (20). As the crankshaft (20) rotates and the piston (12) reaches the upper most position, the intake port (18) is closed. As the crankshaft (20) continues to rotate, the exhaust port (34) on the opposite side of the crankcase (16) opens up. As the piston (12) continues to move downward it exhausts the air through the passageway (24) into the channel (22) and out through the exhaust port (34). The cycle then repeats.

Figure 2:
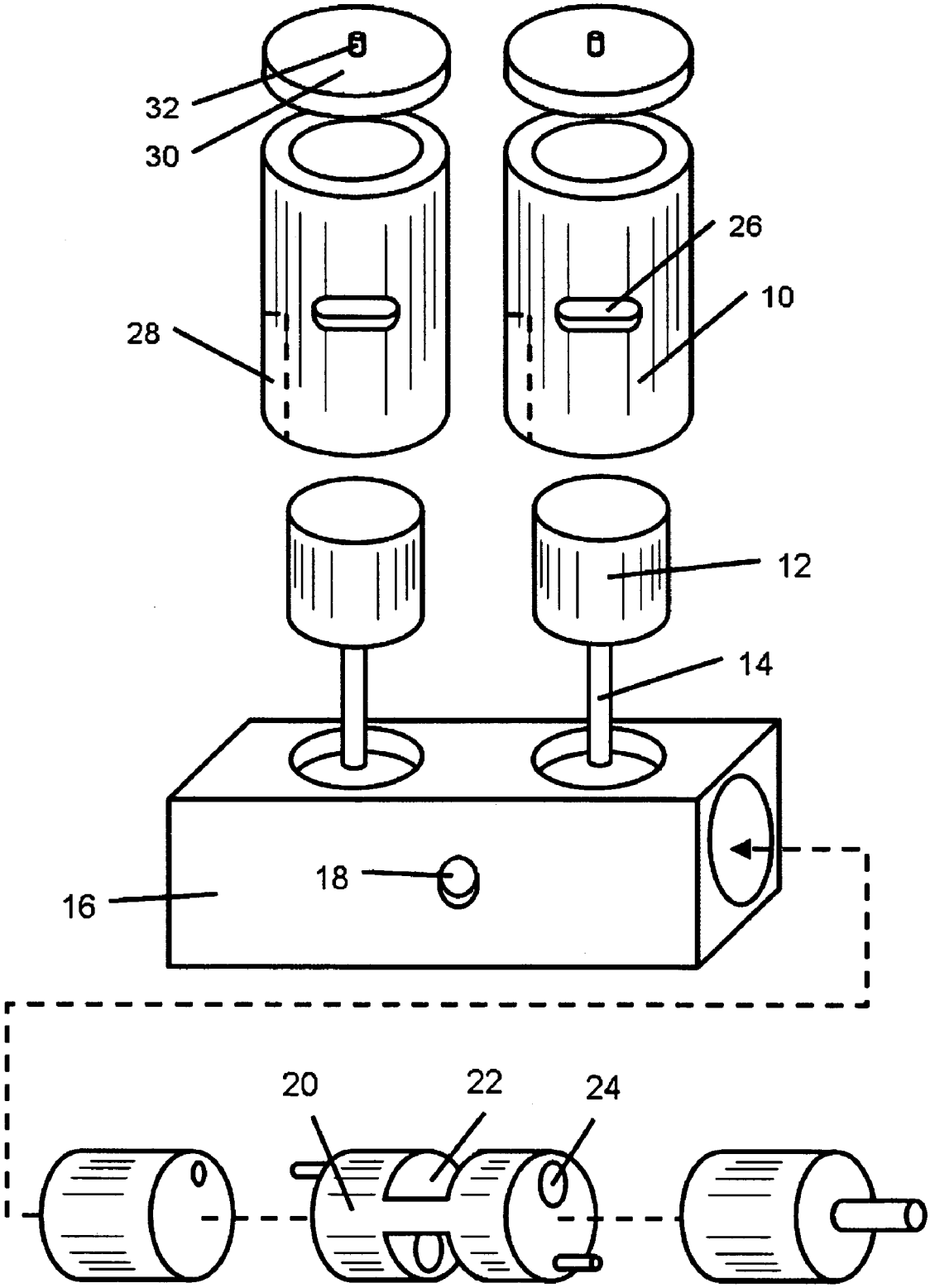
FIG. 2 shows an exploded view of the crankshaft rotary valve as used in a 2-cycle engine.

An alternative embodiment of the crankshaft rotary valve is shown in FIG. 2. By adding a 2-cycle exhaust port (26), cylinder head (30), ignition source (32) and transfer port (28) the crankshaft rotary valve is useful in 2-cycle, or 2-stroke, engines. The cycle begins with the piston (12) at the upper most position. The ignition source (32) ignites the compressed fuel air mixture in the cylinder (10) and forces the piston (12) down. As the piston (12) moves down it rotates the crankshaft (20) while also compressing the air fuel mixture in the crankcase chamber. As the piston (12) moves downward, it exposes the exhaust port (26) and exhausts the combusted air fuel mixture. As the piston (12) continues downward it exposes the transfer port (28) in the side wall of the cylinder (10) and the compressed air fuel mixture in the crankcase chamber is forced from the crankcase chamber through the transfer port (28) and into the cylinder (10) above the piston (12). As the piston (12) reverses direction and moves upward, it closes the transfer port (28) then the exhaust port (26) and creates a vacuum in the crankcase chamber. As the crankshaft (20) rotates, the channel (22) aligns with the intake port (18) and the vacuum in the crankcase chamber draws in a new charge of air and fuel. As the piston reaches the upper most position, the crankshaft (20) rotates and the channel (22) is no longer aligned with the intake port (18) and is closed. Once the piston (12) reaches the uppermost position, the air fuel mixture is compressed in the cylinder (10) and ignited by the ignition source (32). The cycle then repeats.

I claim:

1. A device comprising:

a. a crankcase;

b. a cylinder integral with said crankcase;

c. a piston configured so as to allow reciprocal motion of said piston in said cylinder;

d. a crankshaft mounted in said crankcase configured so as to allow for rotation of said crankshaft in said crankcase;

e. said crankshaft configured so as to form a cylindrical crankshaft bearing surface between said crankshaft and said crankcase;

f. said crankshaft bearing surface having a diameter of at least the stroke distance;

g. a crankcase chamber formed by said crankcase, said piston and said crankshaft;

h. a connecting rod configured between said piston and said crankshaft so as to allow reciprocal motion of said piston in said cylinder;

i. a port in said crankcase circumferentially located to said crankshaft bearing surface;

j. a channel located within said crankshaft configured so as to communicate with said port and a passageway;

k. said passageway configured so as to allow communication between said channel and said crankcase chamber.

2. The device as defined in claim 1 wherein the number of said cylinders is at least 2.

* * * * *